US009683566B2

(12) United States Patent
Bindig et al.

(10) Patent No.: US 9,683,566 B2
(45) Date of Patent: Jun. 20, 2017

(54) SELF-FIXING STATOR HOUSING

(71) Applicant: NETZSCH Pumpen & Systeme GmbH, Selb (DE)

(72) Inventors: Christian Bindig, Wunsiedel (DE); Frank Götz, Mühldorf (DE)

(73) Assignee: NETZSCH Pumpen & Systeme GmbH, Selb (DE)

( * ) Notice: Subject to any disclaimer, the term of this patent is extended or adjusted under 35 U.S.C. 154(b) by 164 days.

(21) Appl. No.: 14/532,765

(22) Filed: Nov. 4, 2014

(65) Prior Publication Data

US 2015/0056092 A1 Feb. 26, 2015

Related U.S. Application Data

(63) Continuation of application No. PCT/DE2013/100164, filed on May 2, 2013.

(30) Foreign Application Priority Data

May 4, 2012 (DE) ..... 10 2012 008 758
Dec. 10, 2012 (DE) ..... 10 2012 112 044

(51) Int. Cl.
*F01C 5/00* (2006.01)
*F04C 2/107* (2006.01)

(52) U.S. Cl.
CPC ..... *F04C 2/1075* (2013.01); *F04C 2230/60* (2013.01); *Y10T 29/49242* (2015.01)

(58) Field of Classification Search
CPC ..... F04C 2/1075
See application file for complete search history.

(56) References Cited

U.S. PATENT DOCUMENTS 4,850,957 A * 7/1989 Summers ..... A61B 1/12 418/48
7,316,548 B2 * 1/2008 Jager ..... F04C 2/1075 138/138

(Continued)

FOREIGN PATENT DOCUMENTS

DE 3312197 A1 10/1984
DE 102008021920 A1 2/2009

(Continued)

OTHER PUBLICATIONS

International Search Report Application No. PCT/DE2013/100164 Completed: Mar. 17, 2014; Mailing Date: Mar. 27, 2014 2 pages.

*Primary Examiner* — Jesse Bogue
(74) *Attorney, Agent, or Firm* — WHITMYER IP GROUP LLC

(57) ABSTRACT

A stator casing of an eccentric screw pump with an elastomer stator inner part including a plurality of shell-like casing segments and a production method for such a stator casing, with which the outlay for maintenance work can be reduced. According to the invention, casing segments adjacent in the longitudinal direction of the stator casing are disposed offset with respect to one another around the longitudinal axis of the stator casing, wherein each casing segment includes connection means and at least four casing segments engage with one another and form a composite. For the production of the stator casing, the casing segments are acted upon by an axial force component as a result of clamping, wherein the casing segments engage with one another, as a result of which a radial force component is generated and the composite is formed.

20 Claims, 5 Drawing Sheets

(56) References Cited

U.S. PATENT DOCUMENTS

| | | | | |
|---|---|---|---|---|
| 7,329,106 | B2 * | 2/2008 | Jager | F04C 15/0003 166/236 |
| 7,407,372 | B2 * | 8/2008 | Guidry | F04C 15/0003 138/138 |
| 2005/0147516 | A1 * | 7/2005 | Kamal | F04C 2/1075 418/48 |
| 2010/0196182 | A1 * | 8/2010 | Loeker | F04C 2/1075 418/48 |
| 2013/0084175 | A1 * | 4/2013 | Thomas | F04C 2/1075 415/208.1 |

FOREIGN PATENT DOCUMENTS

| | | | |
|---|---|---|---|
| DE | 102009015024 | B3 | 7/2010 |
| GB | 2021199 | A | 11/1979 |
| GB | 2481226 | A | 12/2011 |

* cited by examiner

SELF-FIXING STATOR HOUSING

FIELD OF THE INVENTION

The invention relates to a stator casing of an eccentric screw pump with an elastomer stator inner part comprising a plurality of shell-like casing segments. Furthermore, the invention relates to a casing segment for such a stator casing and a method for producing a stator.

BACKGROUND OF THE INVENTION

An eccentric screw pump essentially comprises a screw-shaped rotor mounted rotatably in a stator, which rotor rotates with its longitudinal axis eccentrically around the stator axis. The side of the stator facing the rotor comprises a double-lead helix having a double pitch and corresponding to the rotor shape. The clear space of the stator forms in cross-section a rectangular area with two semicircular areas adjoining the sides lying opposite one another, the diameter of said semicircular areas corresponding to the diameter of the rotor shape. A plurality of chambers of equal size thus arises between the rotor and the stator, in which chambers the delivered material, on account of the different pitches of the rotor and the stator, is moved in its axial direction through the stator. The rotor is usually made from a low-abrasion material such as steel for example and the stator is made, amongst others things, from an elastic material, such as rubber for example.

The elastomer stator inner part is often provided in practice with a steel casing, rubber-like material being vulcanised for example into the casing. On account of its material, the stator is subject to a comparatively high degree of wear, for which reason a replacement of the stator or the stator casing is required at regular intervals. Solutions have repeatedly been sought in the past to keep the maintenance work required for a replacement to a minimum.

An eccentric screw pump with at least one stator made of an elastic material and a rotor mounted in the stator is proposed for example in DE 10 2008 021 920 A1, wherein the stator is provided with segment strips overlapping one another which completely surround the stator.

An eccentric screw pump with a stator casing comprising segments connected to one another in a form-fit manner is disclosed in DE 33 12 197 A1. The form-fit connection is produced by means of a kind of tongue-and-groove joint.

It would however be desirable for a stator with a stator casing comprising segments to be made available, with which the segments could be fitted and removed particularly easily and with little time consumption. The segments themselves, in particular without the use at further auxiliary stabilising elements, should endow the stator with the required rigidity. The known solutions of the aforementioned kind, however, have only a limited suitability.

SUMMARY OF THE INVENTION

The problem underlying the invention, therefore, is to provide a stator casing of the type mentioned at the outset and a production method for such a stator casing, with which the outlay on maintenance work can be reduced.

This problem is solved with an elastomer stator inner part with a plurality of shell-like casing segments disposed in the longitudinal direction of the stator casing. The casing segments adjacent in the longitudinal direction of the stator casing are disposed offset with respect to one another around the longitudinal axis of the stator casing and are coupled with one another, wherein each casing segment comprises connection means and at least four casing segments engage with one another and form a composite as a stator casing. According to the invention, the positioning means are constituted for this purpose tooth-like at the end face.

The invention proceeds from the consideration that, by the use of a stator casing comprising not only one part, the stator replacement is comparatively easy and less time-consuming. The segments of the casing should be able to be released and fitted again without an additional tool. On the other hand, however, the main functions of the stator casing, i.e. above all endowing the stator with the necessary rigidity, should as far as possible not be adversely affected.

This is achieved in particular by the fact that the individual casing segments surround the stator as a whole, wherein the casing segments are connected to one another detachably and at least four casing segments form a stable composite. For this purpose, each casing segment is provided with connection means, which preferably serve at the same time as positioning means and enable a defined position of the casing segments with respect to one another. For this purpose, the connection means preferably have shapes corresponding to one another, in such a way that the segment provided with the positioning means engages in an adjacent segment and a form-fit or a form-fit and friction-locked connection thus arises. Casing segments adjacent to one another in the longitudinal direction of the stator are also disposed offset with respect to one another around the stator longitudinal axis.

In order also to counteract slipping out of position or even detachment of the casing segments, the latter are provided in the region of the connection with elements by means of which locking is enabled, whereby at least two corresponding elements of two adjacent casing segments constitute a locking means. The casing segments can then be secured in the axial direction by means of a clamping device, as a result of which the actual rigidity of the stator casing and therefore also the required rigidity of the stator can ultimately be achieved.

Casing segments adjacent in the longitudinal direction of the stator casing are preferably disposed offset through 90° with respect to one another around the longitudinal axis of the stator casing. A particularly effective connection of the casing segments with one another is thus achieved, whereby the casing segments surround the stator in a mesh-like manner. With such an arrangement, two casing segments are preferably disposed distributed at the circumference of the stator, the latter being followed by a segment pair adjacent in the longitudinal direction of the stator, disposed offset through 90° around the stator longitudinal axis. On account of the positioning means engaging into one another, the stator is surrounded in the region of the pair connection not only by two casing segments, but by a total of four segment sections.

For an effective design of the stator, the stator casing comprises at least four casing segments. The effect of this is that the coupling of the casing segments with one another is improved by the formation of a mesh-like connection with four linkage points.

At least six casing segments are preferably disposed distributed over the entire circumference of the stator. It can be seen to be advantageous that, with a relatively large stator, correspondingly large casing segments are not necessarily also required. A further advantage results from the fact that a self-supporting length of the casing segment is shortened. "Self-supporting length" is understood to mean the free length of the casing segments. The greater the self-supporting length of the casing segments, the greater the risk that the casing segments will bend during the operation of the eccentric screw pump. On account of the motion of the rotor, forces acting radially outwards occur, which can lead to such a bending load on the casing segments.

The size of the casing segments relative to the stator surface covered by the segment can differ from segment to segment. In particular, the casing segments can have different lengths. For example, in the case of a stator casing comprising a total of six casing segments, two relatively large casing segments are distributed centrally at the circumference of the stator and two relatively small casing segments are disposed in each case at the end faces.

The locking means provided as a possible additional securing means is preferably constituted by connection means of the casing segments, said connection means engaging into one another. It is advantageous in this embodiment that the connection means, apart from their function of forming a stable composite and if need be aligning the casing segments with one another, also constitute a position securing means.

Furthermore, it may be advantageous to provide the stator casing with structural elements extending radially at its outer side. A material and weight saving is thus enabled, without the stator being significantly impaired in its rigidity, by the fact that the structural elements form hollow spaces. Recesses for accommodating clamping elements can be provided in the structural elements. The casing segments are clamped between the fastening flange and the pump housing with the aid of the clamping elements running in the longitudinal direction of the stator.

In order to fix the stator casing axially on the elastomer stator inner part, this stator component can also be provided with holding elements. For example, the holding elements are constituted as end-face projections. In particular, the end-face ends of the elastomer stator inner part are provided with a collar for this purpose. In this regard, the casing segments disposed at the end face of the stator can have a shape accommodating the collar. Such an embodiment of the stator advantageously permits, despite the collar-side fixing, a certain axial mobility of the elastomer stator inner part.

In order that the elastomer stator component in the stator casing does not also rotate due to the motion of the rotor during the pump operation, the stator can be constituted polygonal, it then in turn being surrounded by a likewise polygonal stator casing.

The casing segments for a stator casing according to the invention are preferably provided at the end face with connection means constituted tooth-like, wherein at least one tooth flank runs helically. The individual casing segments can this be fitted on the stator and positioned relative to one another in a particularly straightforward manner. For this purpose, the positioning means have shapes corresponding to one another, so that, in each case between two connection means of a segment, a connection means of an adjacent segment can be accommodated in a form-fit manner. The connection means thus serve at the same time as positioning means.

As a result of the likewise corresponding helical course of two mutually opposite tooth flanks, a locking means is thus constituted by means of a kind of undercut.

An additional locking means, as already described above, can be created in that two adjacent casing segments on the one hand comprise one or more projections, which on the other hand lie opposite recesses introduced into the adjacent segment, which serve as locking elements.

According to a preferred development, the tooth flanks of the connection means run helically in the region of the recess.

Especially in the case of an embodiment with more than four casing segments disposed in the circumference of the stator, the assembly and dismantling of the casing segments is thus simplified. For example, connection means of casing segments adjacent in the circumference of the stator do not have a helical tooth flank, whereas the tooth flanks of the connection means of casing segments adjacent in the longitudinal direction of the stator run helically.

The connection means are preferably constituted by a V-shaped or U-shaped recess running out in the longitudinal direction of the stator casing at the end face of the stator segment. The casing segments therefore each comprise two tooth-like connection means at the end face. The connection means each engaging into one another are constituted in such a way that the connection means have a shape corresponding to the recess, in particular the recesses of adjacent casing segments are either V-shaped or U-shaped.

The recess in the casing segment is particularly preferably introduced along a part of the structure extending radially from its outer side. A contact area of the mutually opposite connection means, or of the mutually opposite casing segments, is thus achieved, said contact area being widened compared to the wall thickness of the stator casing. The rigidity of the stator casing can thus be further improved.

In order to produce the stator according to the invention, the latter is clamped in the eccentric screw pump in such a way that the casing segments are acted upon with axial force components as a result of the clamping, wherein the casing segments engage with one another, as a result of which a radial force component is generated and a composite is formed.

The radial force component arises on account of the particular inventive form of the connection means. As a result of the helical course of the end faces, the contact areas of the connection elements are pressed against one another in such a way that, as in the case of inclined planes, due to the axially acting force, a radial force component presses together the connection means of adjacent casing segments and the casing segments form a firm composite.

The advantages achieved with the invention consist in particular in the fact that the shell-like casing segments are fitted particularly easily to the stator in a self-supporting manner and form a secure stator casing after the clamping. When necessary, the stator, which as already described is subject to a comparatively high degree of wear, can be replaced with little outlay. Due to the fact that an active interaction arises between the adjacent casing segments when the casing segments are brought together, a stable and torsion-resistant composite is produced to form a stator casing.

Examples of embodiment of the present invention are described by way of example by reference to the appended drawings.

DETAILED DESCRIPTION OF THE INVENTION

Identical parts are provided with the same reference numbers in all the figures.

Figure 1:
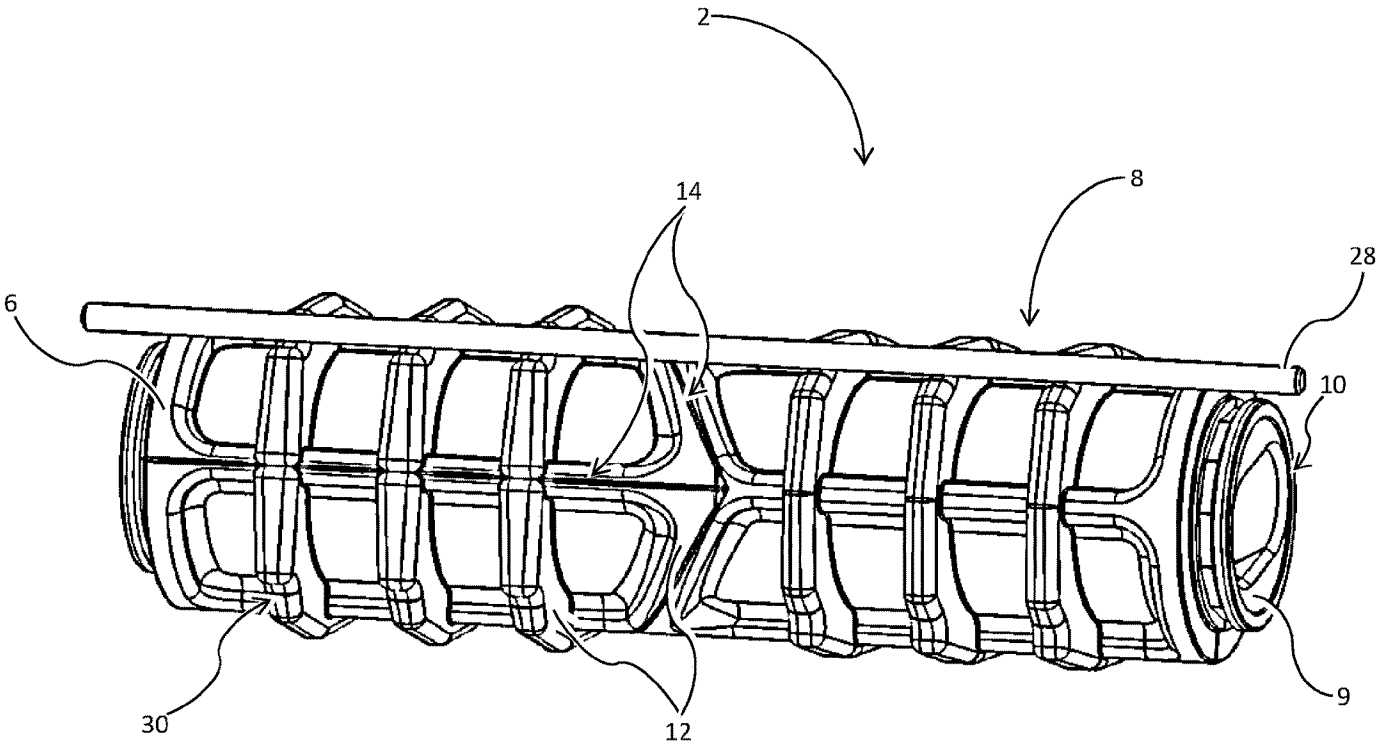
FIG. 1 shows a stator with a stator casing comprising four shell-like casing segments.

FIG. 1 shows the stator (2) of an eccentric screw pump (4), which is surrounded at its circumference by shell-like casing segments (6) of equal size, which form the stator casing (8). On account of the inventive embodiment of the casing segments (6), the latter are disposed at the outer side of the elastomer stator inner part (9). The latter is made of a rubber-like material with elastic properties, whereas the stator casing (8) is produced from a metallic material. The elastomer stator inner part (9) is provided at its ends, on the end face, with projections constituted as a collar (10), which are adjoined by the stator casing (8) at the end face, wherein the stator casing (8) is held axially between the collars (10) and, on account of the elastic properties of the stator inner part (9), is pretensioned.

Furthermore, the stator casing (8) is provided with structural elements (12) extending radially from its outer side, said structural elements surrounding the stator casing (8) in a rib-like or web-like manner. The axially running structural elements (12) serve in particular to ensure sufficient rigidity of the stator casing (8) and the structural elements (12) running at the circumference essentially serve to take up compressive forces acting in the stator. In the region of the connection points (14) of the casing segments (6), the structural elements (12) of a segment (6) are each formed together with an adjacent segment (6).

Since the casing segments (6) are clamped over the length of the stator casing (8), recesses (30) are provided in the structural elements (12) to accommodate the clamping elements (28).

Figure 2:
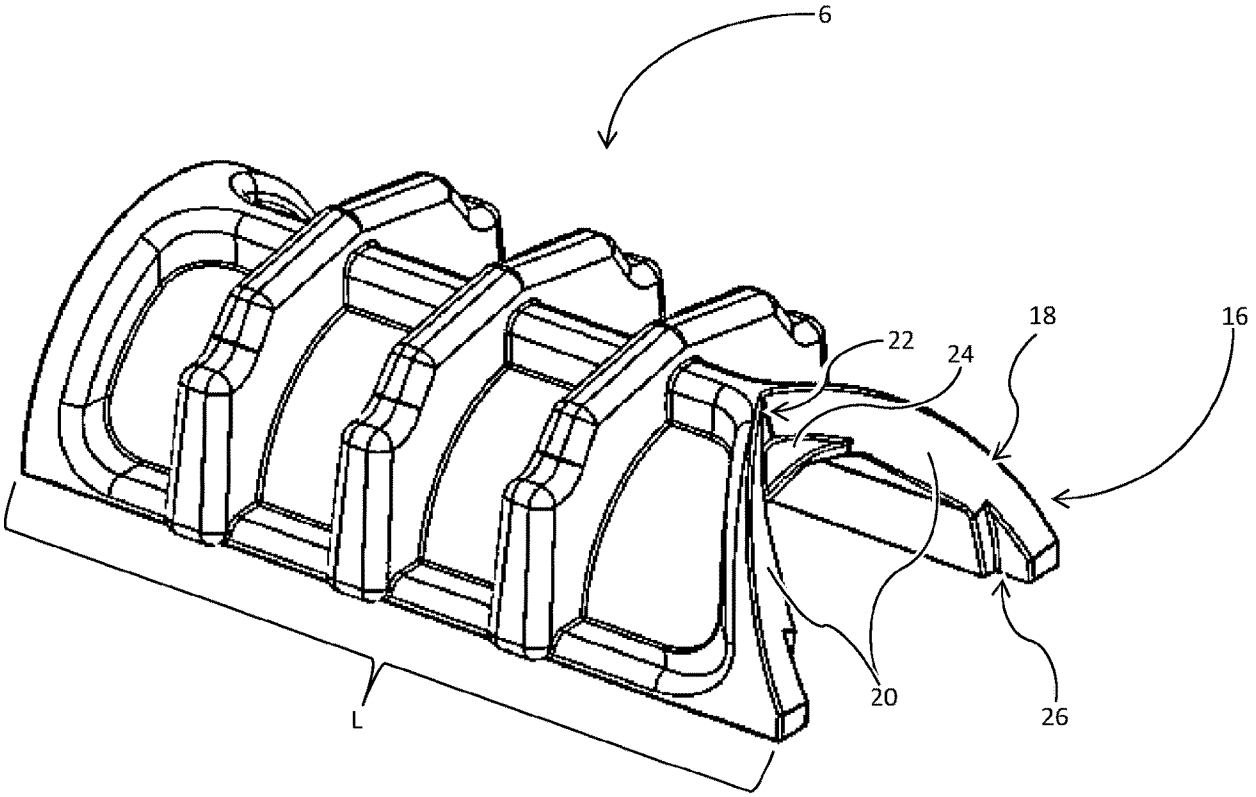
FIG. 2 shows a casing segment of a stator casing from FIG. 1.

An individual casing segment (6) of the stator casing from FIG. 1, with a V-shaped recess (16) running out in the longitudinal direction of the stator casing (8) at the end face and with a self-supporting length L, is represented in FIG. 2. The two tooth-like connection means (18) thus constituted comprise a helically running tooth flank (20) with a contact face wound around its longitudinal axis. The starting point (22) of the recess at the same time represents the start of the tooth flanks (20). From there, a projection extending the inner area of the casing segment (6) and constituted as a locking element (24) projects into the recess. A recess (26) corresponding to the locking element (24) is also introduced at the tooth-like tip in an end region of the connection means (18). The ends of the connection means (18) are truncated, mainly to counteract their being wedged in the adjacent casing segment (6).

The locking element (24) and the recess (26) on the one hand constitute an additional locking means, but on the other hand also serve to compensate for manufacturing tolerances in the production of the casing segments (6).

Figure 3:
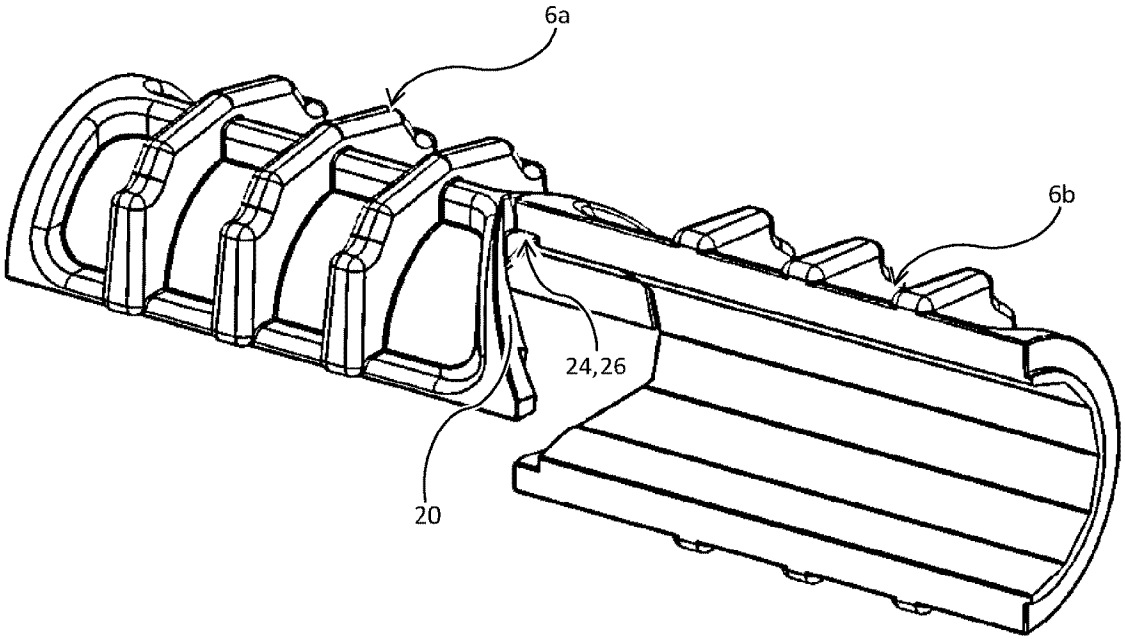
FIG. 3 shows two casing segments adjacent in the longitudinal direction of the stator casing, said casing segments being disposed offset through 90° around the longitudinal axis of the stator casing.

As represented in FIG. 3, the casing segments (6) adjacent in the longitudinal direction, in the case of a stator casing (8) as shown in FIG. 1, are disposed offset through 90° with respect to one another around the longitudinal axis. The inner side of the casing segments (6), as also the outer side of the elastomer stator inner part (9) not represented here, is constituted polygonal. The two casing segments (6) form a stator casing composite at the connection side by means of the helically running areas (20) of the connection means (18) and also by means of the locking element (24) constituting the locking means and the associated recess (30).

On account of the connection means (18), the casing segments (6) can be jointed together without auxiliary means in a particularly straightforward and secure manner. The surface size of the tooth flank (20) also plays a decisive role. Since the wall thickness of the stator casing (8), for the purpose of saving weight and material, is rather small compared to the size of the casing segments (6), the area (20) should as far as possible be greater than the wall thickness. This is achieved by the fact that the recess (16) of the casing segments (6) is introduced along a structural element (12). As a result of the increase in the size of the area (20), the locking effect of the connection means (18) is also increased.

Figure 4:
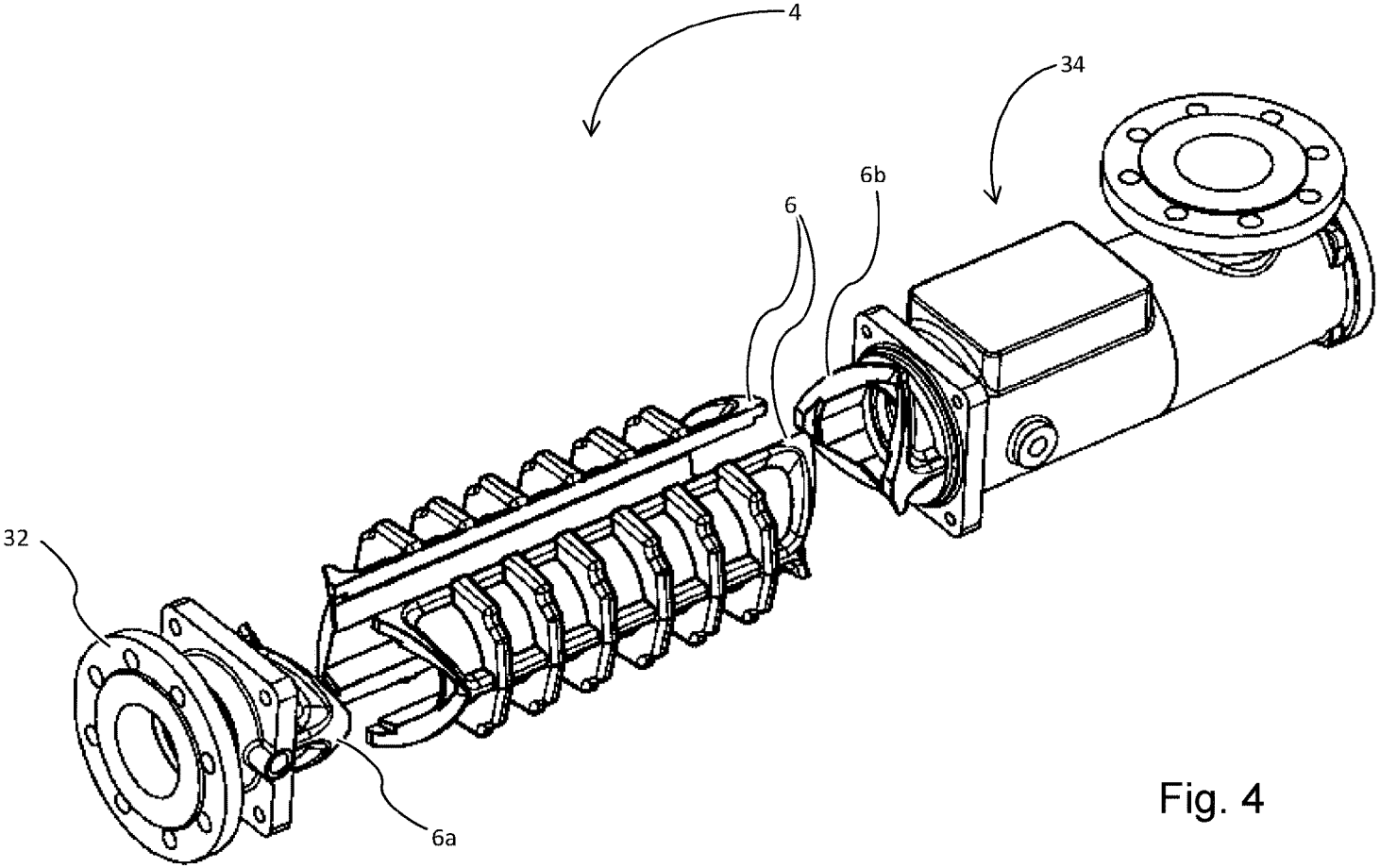
FIG. 4 shows the exploded representation of an eccentric screw pump with a stator comprising six shell-like casing segments, wherein two relatively large casing segments are disposed distributed centrally on the circumference of the stator and two relatively small casing segments are disposed in each case at the end faces

An eccentric screw pump (4) with a total of six shell-like casing segments (6) is shown in FIG. 4. In this embodiment, two shortened casing segments (6*a*, 6*b*) are disposed in each case at the end faces of the stator casing (8), which are disposed on the one hand on a fastening flange (32) and on the other hand on a pump housing (34). Two relatively large casing segments (6) surround the stator inner part (9) centrally, between the shortened casing segments (6*a*, 6*b*).

Figure 5:
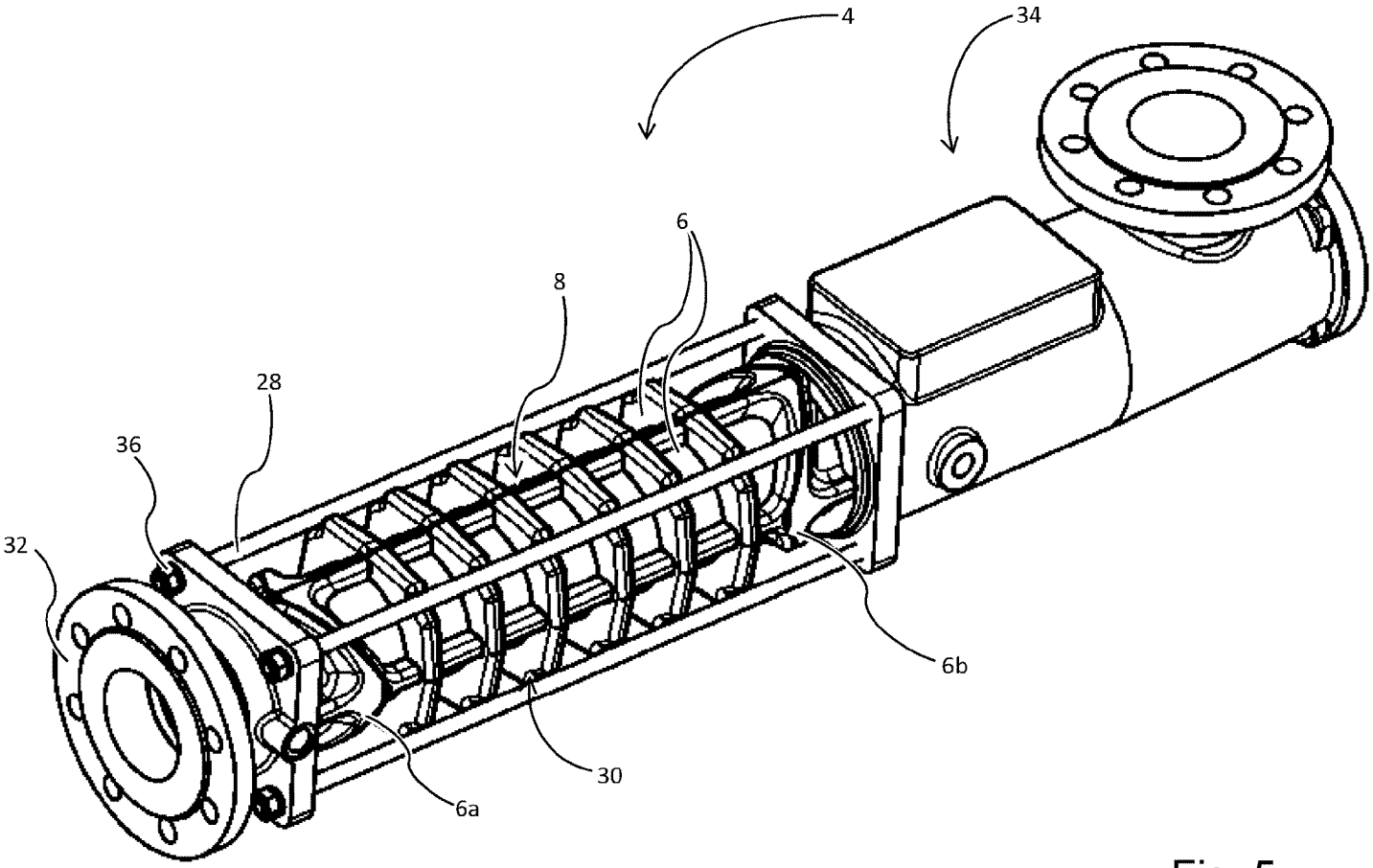
FIG. 5 shows an eccentric screw pump as shown in FIG. 4, with clamped casing segments.

FIG. 5 shows a ready-assembled eccentric screw pump (4), as already represented in FIG. 4, with a stator (2) clamped by means of clamping elements (28) between a pump housing (34) and a flange (32). The clamping elements (28) run in the longitudinal direction of the stator casing (8), for which reason all the structural elements (12) are provided with recesses (30) along the clamping elements (28). In this embodiment, metal rods (28) serve as clamping elements, the ends whereof are provided with a metric screw thread. By screwing on and tightening up the associated screw nuts (36), the individual casing segments (6) are fixed and form a stable casing (8) around the elastomer stator inner part (9).

The eccentric screw pump (4) is specifically designed for straightforward and time-saving assembly and dismantling of the stator casing (8) in order to keep the expenditure for replacement of the elastomer stator inner part (9) as low as possible. It is particularly advantageous that, as a result of the inventive structure of the stator casing (8), wherein the stator casing (8) is constituted by a plurality of self-retaining and self-centering casing segments (6), the casing segments (6) can be fitted to the elastomer stator inner part (9) without additional auxiliary means and without special knowledge and can also be removed again when necessary. The production and repair of such a stator casing (8) is also relatively low-cost, since the casing segments (6), in the case of a stator casing (8) with four casing segments (6) of equal size disposed at the circumference of the stator inner part (9) as shown for example in FIG. 1, are identical in their shape.

LIST OF REFERENCE NUMBERS

2 stator
4 eccentric screw pump
6 casing segment
8 stator casing

10 collar
12 structural element
14 connection point
16 V-shaped recess
18 connection means/positioning means
20 tooth flank (helical)
22 start of the tooth flank
24 locking element
26 recess for locking element
28 clamping element
30 recess for clamping element
32 fastening flange
34 pump housing
36 screw nut
L self-supporting length

What is claimed is:

1. A stator casing of an eccentric screw pump with an elastomer stator inner part comprising a plurality of shell-like casing segments, characterised in that casing segments adjacent in the longitudinal direction of the stator casing are disposed offset with respect to one another around the longitudinal axis of the stator casing, wherein each casing segment comprises at least one connector, and at least four casing segments engage with one another and form a composite stator casing, and each of the four casing segments are adapted to be removed from the stator casing for replacement.

2. The stator casing according to claim 1, the at least one connector is also at least one positioner.

3. The stator casing according to claim 1, the casing segments adjacent in the longitudinal direction of the stator casing being disposed offset through 90° with respect to one another around the longitudinal axis of the stator casing.

4. The stator casing according to claim 1, the stator casing further comprising at least six casing segments.

5. The stator casing according to claim 1, at least two of the casing segments having different lengths from each other.

6. The stator casing according to claim 1, the elastomer stator inner part further comprising holding elements which fix the stator casing.

7. A casing segment for a stator casing according to claim 1, the at least one connector being constituted tooth-like at an end face.

8. The casing segment according to claim 7, further comprising at least one tooth flank of the tooth-like end face running helically around the longitudinal axis.

9. The casing segment according to claim 7, further comprising tooth flanks of the tooth-like end face running helically around the longitudinal axis in a region of a recess.

10. The casing segment according to claim 7, the at least one connector further comprising a V- or U-shaped recess running out in the longitudinal direction of the stator casing at the end face of the casing segment.

11. The casing segment according to claim 7, further comprising a recess introduced along a part of structural elements extending radially from an outer side.

12. The casing segment according to claim 7, further comprising a locking element which projects into a recess and that a recess corresponding to the locking element is introduced in an end region of a positioner.

13. An eccentric screw pump with a stator casing comprising a plurality of shell-like casing segments according to claim 1.

14. The stator casing according to claim 1, wherein the casing segments are clamped together to form the composite stator casing.

15. The stator casing according to claim 1, wherein the casing segments comprise metallic material.

16. The stator casing according to claim 1, wherein the casing segments each have substantially the same shape.

17. A stator casing of an eccentric screw pump, comprising four shell-like casing segments adjacent in a longitudinal direction of the stator casing disposed offset with respect to one another around the longitudinal direction, each casing segment having a connector to connect adjacent casing segments with each other and form a composite stator casing, each of the casing segments adapted to be removed from the stator casing for replacement.

18. A method for producing a stator, which is clamped in an eccentric screw pump, with an elastomer stator inner part which is surrounded by a plurality of shell-like casing segments, comprising the steps of clamping the casing segments so that they are acted upon by a longitudinal axial force component, engaging the casing segments with one another so that a radial force component is generated and a composite stator casing is formed.

19. The method of claim 18, wherein each of the casing segments are adapted to be removed from the composite stator casing for replacement.

20. A method of maintaining a stator produced according to claim 18, comprising replacing one of the casing segments.

* * * * *